US009881731B2

(12) United States Patent
Yu et al.

(10) Patent No.: US 9,881,731 B2
(45) Date of Patent: Jan. 30, 2018

(54) INTEGRATED TUNABLE INDUCTORS

(71) Applicant: Arizona Board of Regents on behalf of Arizona State University, Scottsdale, AZ (US)

(72) Inventors: Hongbin Yu, Chandler, AZ (US); Hao Wu, Mesa, AZ (US)

(73) Assignee: Arizona Board of Regents on behalf of Arizona State University, Scottsdale, AZ (US)

( * ) Notice: Subject to any disclaimer, the term of this patent is extended or adjusted under 35 U.S.C. 154(b) by 37 days.

(21) Appl. No.: 15/182,358

(22) Filed: Jun. 14, 2016

(65) Prior Publication Data

US 2016/0293326 A1 Oct. 6, 2016

Related U.S. Application Data

(63) Continuation of application No. 14/094,173, filed on Dec. 2, 2013.

(60) Provisional application No. 61/732,631, filed on Dec. 3, 2012.

(51) Int. Cl.

| | |
|---|---|
| ***H01F 5/00*** | (2006.01) |
| ***H01F 29/14*** | (2006.01) |
| ***H01F 21/08*** | (2006.01) |
| ***H01F 41/04*** | (2006.01) |
| ***H01F 1/03*** | (2006.01) |

(52) U.S. Cl.

CPC ..... *H01F 29/146* (2013.01); *H01F 1/0306* (2013.01); *H01F 5/00* (2013.01); *H01F 21/08* (2013.01); *H01F 41/046* (2013.01); *Y10T 29/4902* (2015.01)

(58) Field of Classification Search

CPC ..... H01F 5/00; H01F 27/00–27/36
USPC ..... 336/65, 83, 200, 232
See application file for complete search history.

(56) References Cited

U.S. PATENT DOCUMENTS

| | | | |
|---|---|---|---|
| 4,648,087 | A | 3/1987 | Scranton et al. |
| 5,095,357 | A | 3/1992 | Andoh et al. |
| 6,081,157 | A | 6/2000 | Ikeda et al. |
| 6,940,147 | B2 | 9/2005 | Crawford et al. |
| 7,202,768 | B1 | 4/2007 | Harvey et al. |
| 7,518,481 | B2 | 4/2009 | Gardner et al. |
| 7,733,206 | B2 | 6/2010 | Park |
| 8,029,922 | B2 | 10/2011 | McCloskey et al. |
| 8,108,984 | B2 | 2/2012 | Gardner et al. |
| 8,513,750 | B2 | 8/2013 | Gardner et al. |
| 8,884,438 | B2 | 11/2014 | Gardner et al. |
| 2008/0055037 | A1 | 3/2008 | Watanabe et al. |
| 2009/0174501 | A1 | 7/2009 | Parsche et al. |
| 2012/0002377 | A1 | 1/2012 | French et al. |

OTHER PUBLICATIONS

Donald S. Gardner, et al., "Integrated On-Chip Inductors with Magnetic Films," IEEE Transactions on Magnetics, vol. 43, No. 6, pp. 2615-2617, Jun. 2007.

(Continued)

*Primary Examiner* — Tuyen Nguyen
(74) *Attorney, Agent, or Firm* — Snell & Wilmer L.L.P.

(57) ABSTRACT

An integrated inductor can be tunable via a control current which alters the magnetic flux density in a permeable magnetic material. The resulting inductor can be adjusted in-circuit, and may be suitable for applications such as dc-dc converters, RF circuits, or filters requiring operation at high frequencies and across wide bandwidths.

14 Claims, 13 Drawing Sheets

(56) References Cited

OTHER PUBLICATIONS

Wei Xu, et al., "Sub-100 m Scale On-Chip Inductors with CoZrTa for GHz Applications," American Institute of Physics, Journal of Applied Physics, 109, 07A316 1-3, 2011.
A. Gromov, et al., "Gigahertz Sandwich Strip Inductors Based on Fe-N Films: The Effect of Flux Closure at the Flange," IEEE Transactions on Magnetics, vol. 46, No. 6, pp. 2097-2100, Jun. 2010.
Patrick R. Morrow, et al., "Design and Fabrication of On-Chip Coupled Inductors Integrated with Magnetic Material for Voltage Regulators," IEEE Transactions on Magnetics, vol. 47, No. 6, pp. 1678-1686, Jun. 2011.
Wei Xu, et al., "Performance Enhancement of On-Chip Inductors with Permalloy Magnetic Rings," IEEE Electron Device Letters, vol. 32, No. 1, pp. 68-71, Jan. 2011.
Wei Xu, et al., "Improved Frequency Response of On-Chip Inductors with Patterned Magnetic Dots," IEEE Electron Devices Letters, vol. 31, No. 3, pp. 207-209, Mar. 2010.
Tawab Dastagir, et al., "Tuning the Permeability of Permalloy Films for On-Chip Inductor Applications," Applied Physics Letters 97, 162506, 2010.
Saurabh Sinha, et al., "Enabling Resonant Clock Distribution with Scaled On-Chip Magnetic Inductors," IEEE, International Conference on Computer Design, pp. 103-108, 2009.
O. Donzelli, et al., "Perpendicular Magnetic Anisotropy and Stripe Domains in Ultrathin Co/Au Sputtered Multilayers," Journal of Applied Physics, 93, pp. 9908-9912, 2003.
S.F. Cheng, et al., "Effects of Spacer Layer on Growth, Stress and Magnetic Properties of Sputtered Permalloy Film," J. Magn. Magn. Mater. 282, pp. 109-114, 2004.
M. Frommberger et al., "Integration of Crossed Anisotropy Magnetic Core into Toroidal Thin-film Inductors," IEEE Trans. Microwave Theory Tech. 53 (6), pp. 2096-2100, 2005.
P.E. Kelly, et al., "Switching Mechanisms in Cobalt-Phosphorus Thin Films," IEEE Trans. Magn. 25(5), 3, pp. 881-3883, 1989.
P. Zou, et al., "Influence of Stress and Texture on Soft Magnetic Properties of Thin Films," IEEE Trans. Magn, 38(5), pp. 3501-3520, 2002.
D.S. Gardner, et al., "Review of On-Chip Inductor Structures with Magnetic Films," IEEE Trans. Magn. 45(10), 4760, 2009.
N. Amos, et al., "Magnetic Force Microscopy Study of Magnetic Stripe Domains in Sputter Deposited Permalloy Thin Films," Journal of Applied Physics, 103, 07E732, 2008.
D.S. Gardner, et al., "Integrated On-Chip Inductors Using Magnetic Material," Journal of Applied Physics, 103, 07E927, 2008.
B. Viala, et al., "Bidirectional Ferromagnetic Spiral Inductors Using Single Deposition," IEEE Trans. Magn. 41, 3544, 2005.
D. Flynn, et al., "Influence of Pulse Reverse Plating on the Properties of Ni-Fe Thin Films," IEEE Trans. Magn., vol. 46, No. 4, pp. 979-985, Apr. 2010.
V. Korenivski, et al., "Magnetic Film Inductors for Radio Frequency Applications," Journal of Applied Physics, vol. 82, No. 10, pp. 5247-5254, Nov. 1997.
Y. Zhuang, et al., "Integrated RF Inductors with Micro-Patterned NiFe Core," Solid-State Electron. 51, pp. 405-413, 2007.
Y. Zhuang, et al., "Magnetic Properties of Electroplated Nano/Microgranular NiFe Thin Films for RF Application," Journal of Applied Physics, vol. 97, No. 10, p. 10N305, May 2005.
M. Yamaguchi, et al., "Microfabrication and Characteristics of Magnetic Thin-Film Inductors in the Ultrahigh Frequency Region," Journal of Applied Physics 85, 7919, 1999.
M. Yamaguchi, et al., "Ferromagnetic RF Integrated Inductor with Closed Magnetic Circuit Structure," in Proc. IEEE MTT-S Int, pp. 351-354, Jun. 2005.
C. Yang, et al., "Ferrite-Integrated On-Chip Inductors for RF ICs," IEEE Electron Device Letters, vol. 28, No. 7, pp. 652-655, Jul. 2007.
C. Yang, et al., "Investigation of On-Chip Soft-Ferrite-Integrated Inductors for RF ICS—Part II: Experiments," IEEE Trans Electron Devices, vol. 56, No. 12, pp. 3141-3148, Dec. 2009.
R.F. Jiang, et al., "Exchange-coupled IrMn/CoFe Multilayers for RF-Integrated Inductors," IEEE Trans, Magn., vol. 43, No. 10, pp. 3930-3932, Oct. 2007.
C. Yang, et al., "Investigation of On-Chip Soft-Ferrite-Integrated Inductors for RF ICs—Part I: Design and Simulation," IEEE Trans. Electron Devices, vol. 56, No. 12, pp. 3133-3140, Dec. 2009.
Non-Final Office Action Election/Restriction dated Feb. 23, 2015 in U.S. Appl. No. 14/094,173.
Non-Final Office Action dated Jul. 16, 2015 in U.S. Appl. No. 14/094,173.
Non-Final Office Action dated Oct. 9, 2015 in U.S. Appl. No. 14/094,173.

INTEGRATED TUNABLE INDUCTORS

CROSS-REFERENCE TO RELATED APPLICATIONS

This application is a continuation of U.S. Ser. No. 14/094,173 filed on Dec. 2, 2013, now published as U.S. Patent Application Publication No. 2014-0152410 entitled "INTEGRATED TUNEABLE INDUCTORS". U.S. Ser. No. 14/094,173 claims priority to, and the benefit of, U.S. Provisional Application Ser. No. 61/732,631 entitled "INTEGRATED TUNABLE INDUCTORS" filed on Dec. 3, 2012. Each of the foregoing applications are hereby incorporated herein by reference in their entirety.

TECHNICAL FIELD

The present disclosure relates to integrated circuit inductors, and in particular, integrated circuit inductors which can be varied in inductance via the application of a control current.

BACKGROUND

On-chip inductors are receiving attention as semiconductor devices become increasingly compact. Inductors are particularly difficult to miniaturize due to the principles of electromagnetic fields on which they depend. Furthermore, semiconductor devices employing inductors are being designed to operate over increasingly high frequencies and broad bandwidths, yet also employ increasingly miniaturized components and system-on-a-chip architectures.

Prior approaches often fail to operate satisfactory under these parameters. One such approach is the co-location of a patterned magnetic film near a fixed value inductor. This approach helps to miniaturize the fixed value inductor by influencing the electromagnetic field that surrounds the inductor when operating. However, this approach fails to permit a sufficient degree of miniaturization for many system-on-a-chip applications.

Furthermore, such inductors are of fixed value. The use of fixed value inductors limits the operational frequency and bandwidth ranges of the parent device. In devices that operate at multiple frequencies or across wide bandwidths, it can be advantageous to use inductors of variable value. Thus, there is a need for an integrated inductor which is actively tunable and more highly miniaturizable.

SUMMARY

According to various example embodiments, an integrated tunable inductor is disclosed. In an exemplary embodiment, an integrated tunable inductor comprises a substrate configured to receive an inductor, an inductor located proximate to the substrate, a magnetic material located proximate to the inductor, and a first control line located proximate to the magnetic material. The first control line is configured for the conduction of an electric current. The integrated tunable inductor further comprises a controller configured to tune the magnitude of the electric current.

In another exemplary embodiment, a method of varying the inductance of an integrated tunable inductor comprises passing a first current through a first control line located proximate to an inductor, and inducing a first electromagnetic field to radiate from the control line and traverse a first magnetic material located proximate to the inductor. The first magnetic material has a variable magnetic flux density.

The method further comprises varying the magnitude of the first current in response to the inducing a first electromagnetic field, changing the variable magnetic flux density of the magnetic material in response to the varying the magnitude of the first current, and altering the capacity of the inductor to store energy in a second electromagnetic field radiating from the inductor and traversing the first magnetic material in response to the changing the variable magnetic flux density.

In another exemplary embodiment, a method of manufacturing a planar inductor comprises configuring a substrate to receive an inductor, forming an inductor on the substrate by depositing a conductive material on the substrate, and positioning a first control line proximate to the inductor. The first control line is configured for the conduction of a first electric current. The method further comprises connecting a controller in electrical communication with the first control line, and configuring the controller to tune the magnitude of the first electric current.

BRIEF DESCRIPTION OF THE DRAWINGS

With reference to the following description, appended claims, and accompanying drawings as attached:

DETAILED DESCRIPTION

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the appended claims.

For the sake of brevity, conventional techniques for integrated circuit manufacturing and/or semiconductor preparation may not be described in detail herein. Furthermore, the connecting lines shown in various figures contained herein are intended to represent exemplary functional relationships and/or physical couplings between various elements. It should be noted that many alternative or additional functional relationships or physical connections may be present in a practical method of construction.

In accordance with principles of the present disclosure, an integrated tunable inductor may be constructed on an integrated circuit chip. Moreover, a substrate of the integrated circuit chip may comprise a planar inductor. The planar inductor may be located proximate to a permeable magnetic material and a control line. A controller may control an electric current passing through the control line, thus controllably inducing a magnetic field to traverse the permeable magnetic material and thereby affect the magnetic flux density of the permeable magnetic material. This in turn controllably affects the inductance of the planar inductor. Thus, in an example embodiment, the inductance of the inductor can be varied by varying a control current through the control line.

In accordance with an example embodiment, the relative magnetic flux density of the permeable magnetic material proximate to the inductor is changed by adjusting the magnitude of current flowing in the control line. In turn, this adjusting alters the ability of the inductor to induce a second magnetic field within the permeable magnetic material, thereby adjusting the capacity of the inductor to store energy in this second magnetic field. Consequently, the inductance of the inductor is adjusted via tuning of the current flowing from the controller. Such a device is very useful in applications such as single-chip dc-dc converters, tunable filters, or tunable resonators, and may also be used in any application requiring miniaturized inductors of variable inductance. As a result, a physically small inductor may be made to behave as if it were an inductor of many different sizes, including a physically large inductor.

Figure 1:
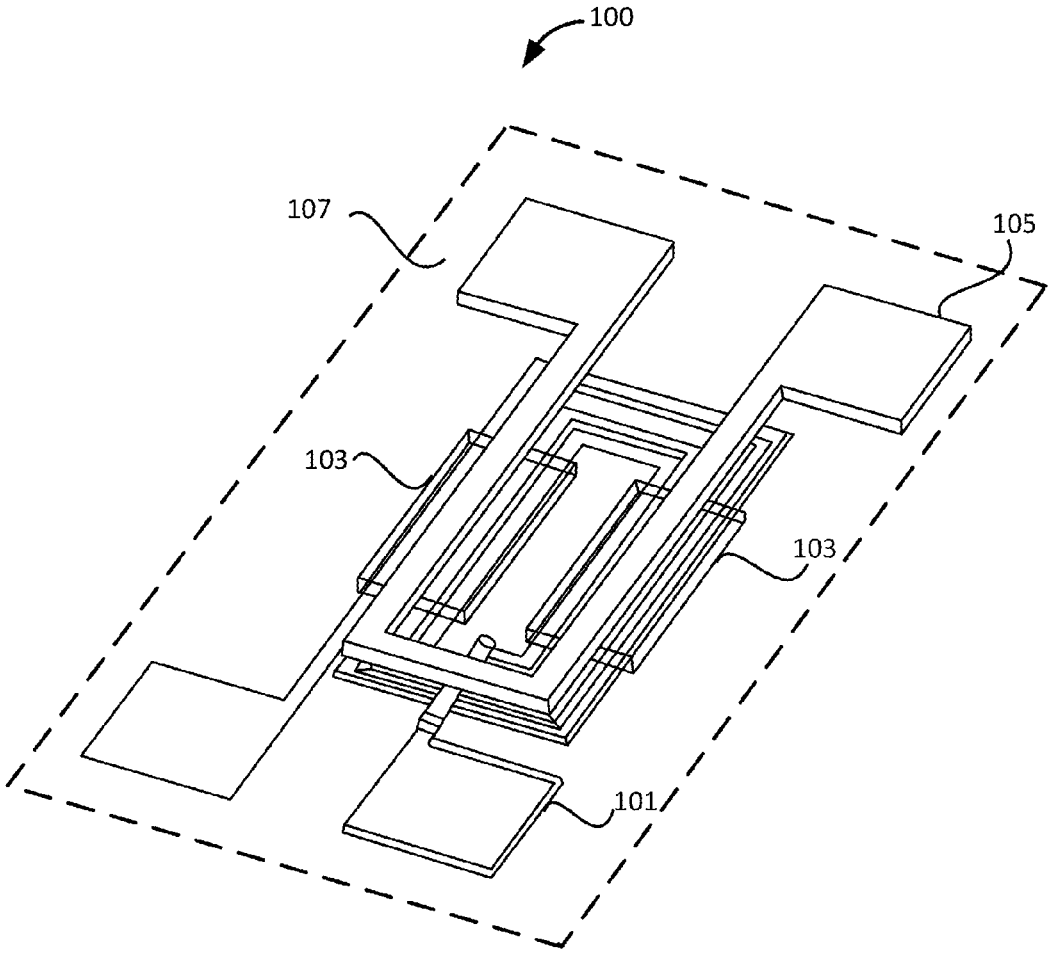
FIG. 1 illustrates an integrated tunable inductor according to various example embodiments.

With reference now to FIG. 1, an exemplary integrated tunable inductor 100 may, in various exemplary embodiments, comprise a substrate 107, a planar inductor 101, a magnetic material 103, and a control line 105.

In some embodiments, the substrate 107 may comprise quartz or any other material or combination of materials suitable to receive the planar inductor 101. In some embodiments, substrate 107 may comprise a semiconductor substrate. For example, substrate 107 may comprise silicon, silicon germanium, gallium arsenide, silicon carbide, gallium nitride, and/or the like, or any other material suitable to receive planar inductor 101. In some embodiments, substrate 107 may comprise an insulating substrate. For example, substrate 107 may be quartz, polyimide, benzocyclobutene, polydimethylsiloxane, and/or the like, or any other material suitable to receive planar inductor 101.

Furthermore, in some embodiments, substrate 107 may be configured to interface with other on-chip integrated devices. For example, substrate 107 may be configured to receive other active or passive devices, or may be configured to support attached devices, or may be attachable to another circuit assembly.

In some embodiments, a planar inductor 101 may be patterned directly atop the substrate or may be affixed in any manner suitable to retain the planar inductor 101 in place. For example, an inductor may be formed by standard CMOS manufacturing processes. In particular, an inductor may be fabricated using electron beam lithography and magnetron sputtering. In some embodiments, standard CMOS manufacturing processes may be used to pattern a copper inductor on the substrate; however, any other conductive material with low resistivity may also be used. For example, planar inductor 101 may be made of copper, silver, gold, and/or the like.

In various example embodiments, planar inductor 101 may be spiral in shape. Furthermore, in various example embodiments, a spiral inductor may comprise four turns, though the planar inductor may comprise any number of turns adapted to achieve a desired inductance or a desired quality factor within a desired device size. For example, a four-turn spiral inductor may have an outer diameter of about 88 μm by 164 μm, with traces about 5 μm wide, about 2 μm thick, and spaced about 3.5 μm apart. Alternatively, an inductor may have any other dimensions suitable for a desired application. For example, in one embodiment, the inductor dimensions are chosen to maximize the range of inductance across which an exemplary integrated tunable inductor 100 may be tuned. In various example embodiments, the inductor dimensions are chosen to maximize the nominal inductance of planar inductor 101. In various embodiments, the inductor dimensions are chosen to achieve a desired quality factor. Moreover, in various embodiments, the inductor dimensions are chosen to achieve various other desired operational characteristics, for example, to satisfy voltage requirements, current requirements, parasitic capacitance requirements, or parasitic resistance requirements.

In some embodiments, planar inductor 101 is patterned according to a strip line structure, a solenoidal structure, a toroidal structure, a finger structure, a bar structure, and/or any other structure with desirable operational characteristics. For example, in one embodiment, a strip line structure may be selected in order to minimize the device size. In various example embodiments, a finger structure or a bar structure may be selected in order to reduce eddy current loss in the magnetic material, or to increase the device quality factor, or to achieve various other operational requirements and/or benefits.

With reference again to FIG. 1, in some embodiments, magnetic material 103 may comprise permalloy (NiFe). In some embodiments, magnetic material 103 may comprise CoP (cobalt-phosphorus), CoZrTa (cobalt-zirconium-tantalum), CoNbZr (cobalt-nobilium-zirconium), FeHfN (iron-hafnium-nitrogen), CoZrTaB (cobalt-zirconium-tantalum-boron), and/or the like. Furthermore, magnetic material 103 may be any material with high permeability and low coercivity.

For example, in accordance with the principles discussed herein, in various embodiments, magnetic material 103 may comprise CoZrTaB. Magnetic material 103 may be deposited on a quartz substrate by magnetron sputtering. The magnetic material 103 may be deposited as a film. Moreover, the magnetic material 103 may be deposited with uniaxial magnetic anisotropy, for example, through the application of an external DC magnetic field in the sputtering chamber during deposition.

In some embodiments, a magnetic material 103 may be located proximate to the planar inductor 101. For example, a continuous ring of magnetic material 103 may physically wrap a portion of the planar inductor 101. For example, with reference to FIG. 8, a continuous ring of magnetic material 803 may physically wrap a portion of planar inductor 801. In some embodiments, magnetic material 803 may be vertically laminated. Vertical lamination inhibits the induction of unwanted magnetic eddy currents. Furthermore, in some embodiments, magnetic material 803 may further comprise intralayer spacer material. In some embodiments, this spacer material is Cr, though any spacer material suitable to enable the vertical laminations to limit magnetic eddy current may be used. For example, cobalt oxide may be used. In various embodiments, cobalt oxide laminations may be formed by introducing oxygen into a sputtering chamber, wherein the magnetic material 103 is deposited onto a substrate 107. In this manner, the interlayer spacer material may comprise cobalt oxide. Moreover, any configuration that achieves desired magnetic eddy current behavior may be implemented.

In various example embodiments, any construction may be used wherein magnetic material 803 is sufficiently proximate to planar inductor 801 to provide a relative increase in permeability of the inductor. In some embodiments, a continuous ring of magnetic material 803 is about 40 μm wide and about 80 μm thick, though any dimensions suitable for limiting the eddy current at a desired operating frequency may be chosen.

Figure 9:
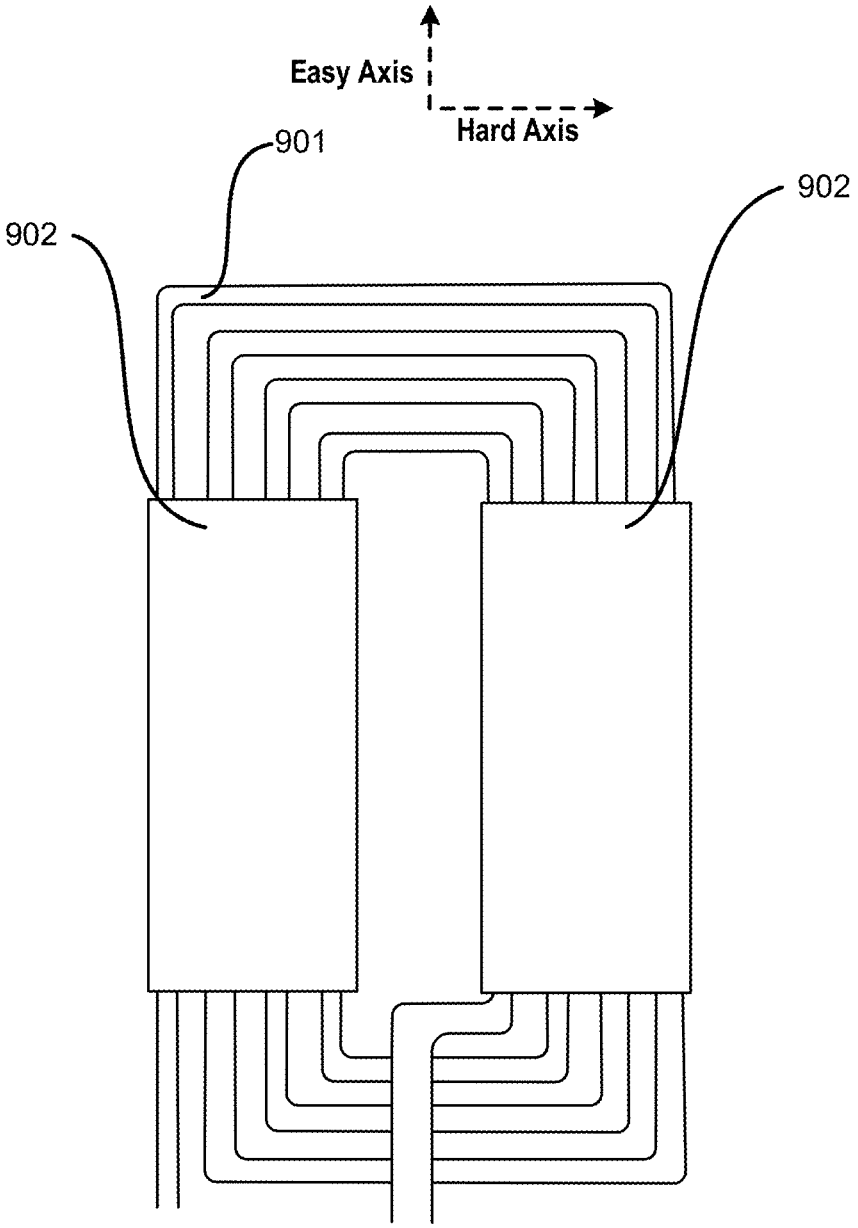
FIG. 9 illustrates various aspects of an integrated tunable inductor according to various example embodiments having a magnetic material comprising a film.

With reference now to FIGS. 1 and 9, in various embodiments, an integrated tunable inductor comprises a film 902 of magnetic material 103. A planar inductor 901 may comprise a four-turn concentric spiral. In various embodiments, a planar inductor 901 may comprise a spiral having any number of turns, for example, a planar inductor 901 may be a concentric spiral having between about 1 turn and about 10 turns. A film 902 of magnetic material 103 may comprise a continuous ring of magnetic material 103 physically wrapping a portion of planar inductor 901. In this manner, the magnetic material 103 may physically surround a portion of the planar inductor 901. Furthermore, in various embodiments, an integrated tunable inductor may comprise two continuous rings of magnetic material 103, for example, circling two different portions of planar inductor 901.

With reference again to FIG. 1, in some embodiments, a magnetic material 103 does not comprise a continuous ring of magnetic material, but comprises a bar structure. For example, a bar structure may be utilized for small signal applications. In some such embodiments, it may be advantageous for the integrated tunable inductor to be highly sensitive to small controller currents. The bar structure may be configured to create an increased anisotropy field. This in turn reduces the magnetic field strength at which the magnetic material reaches a state of full saturation magnetic flux density. Furthermore, narrow bar structures may be utilized to optimize the quality factor of a variable tunable inductor.

Figure 10:
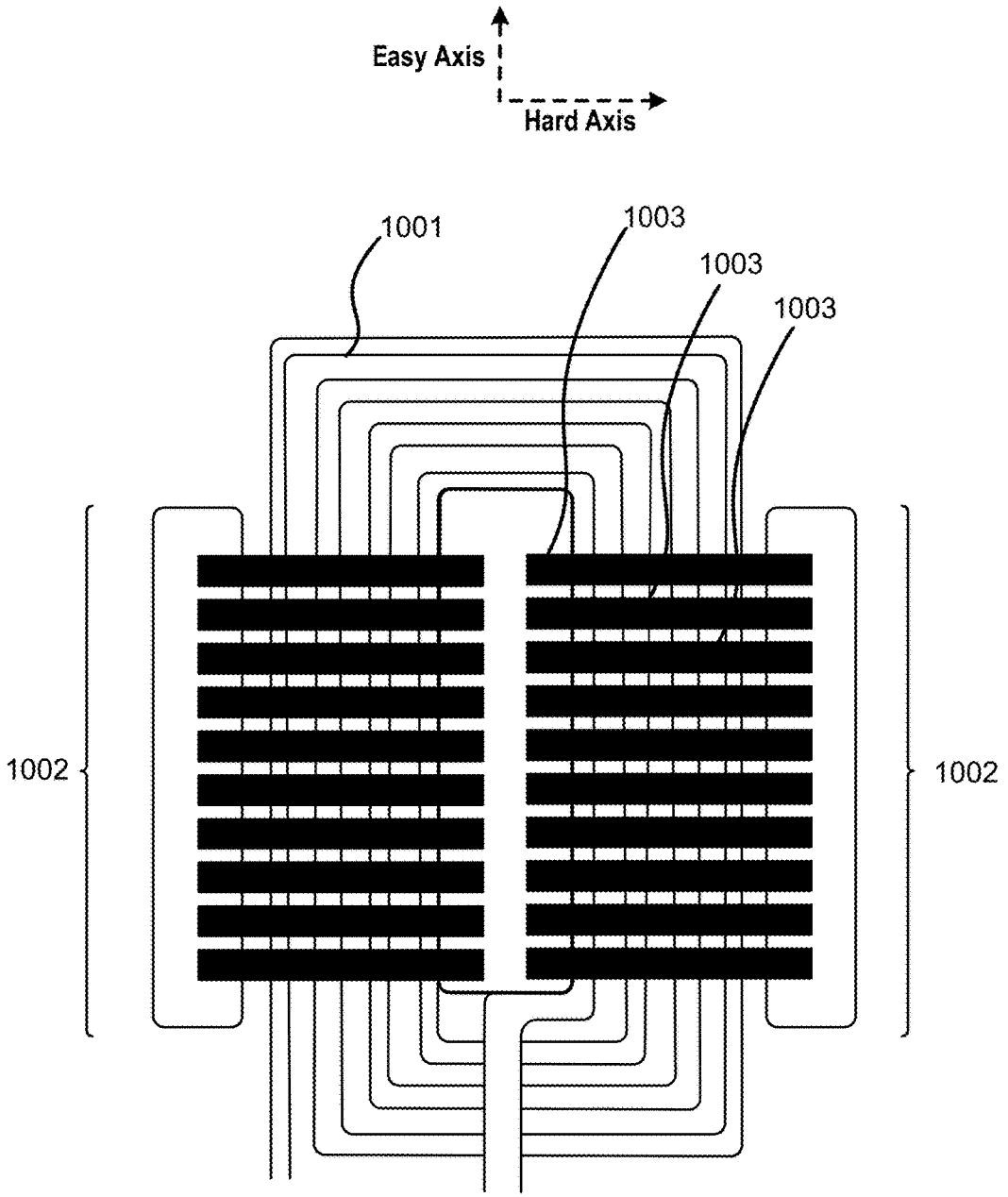
FIG. 10 illustrates various aspects of an integrated tunable inductor according to various example embodiments having a magnetic material comprising a bar structure.

With reference now to FIGS. 1 and 10, in various embodiments, an integrated tunable inductor comprises a bar structure 1002 of magnetic material 103. A planar inductor 1001 may comprise a one to ten turn concentric spiral. In various embodiments, a planar inductor 1001 may comprise a four turn concentric spiral. A bar structure 1002 of magnetic material 103 may comprise a series of bars 1003 traversing a portion of planar inductor 1001. In various embodiments, a bar structure 1002 may traverse two different portions of planar inductor 1001. Moreover, in various embodiments, a bar structure 1002 may comprise ten bars 1003. In various embodiments, a bar structure 1002 may comprise ten bars 1003 traversing one portion of planar inductor 1001, and ten bars 1003 traversing another portion of planar inductor 1001. However, a bar structure 1002 may comprise two bars, four bars, and/or any number of bars adapted to provide desired operating characteristics, for example quality factor, current sensitivity, and the magnetic field strength at which the magnetic material reaches a state of full saturation magnetic flux density.

In various embodiments, a bar structure may be formed according to a process wherein a film of magnetic material 103 is deposited and then is patterned into a bar structure 1002 via electron beam lithography and a lift-off process, for example, an acetone soaking of the device to remove a polymer layer used in the lithography process.

In some embodiments, a magnetic material 103 does not comprise a continuous ring of magnetic material, but comprises a finger structure. For example, a finger structure may be utilized for large signal applications, such as voltage regulators. The finger structure may be configured to increase the magnetic field strength at which the magnetic material reaches a state of full saturation magnetic flux density.

Figure 11:
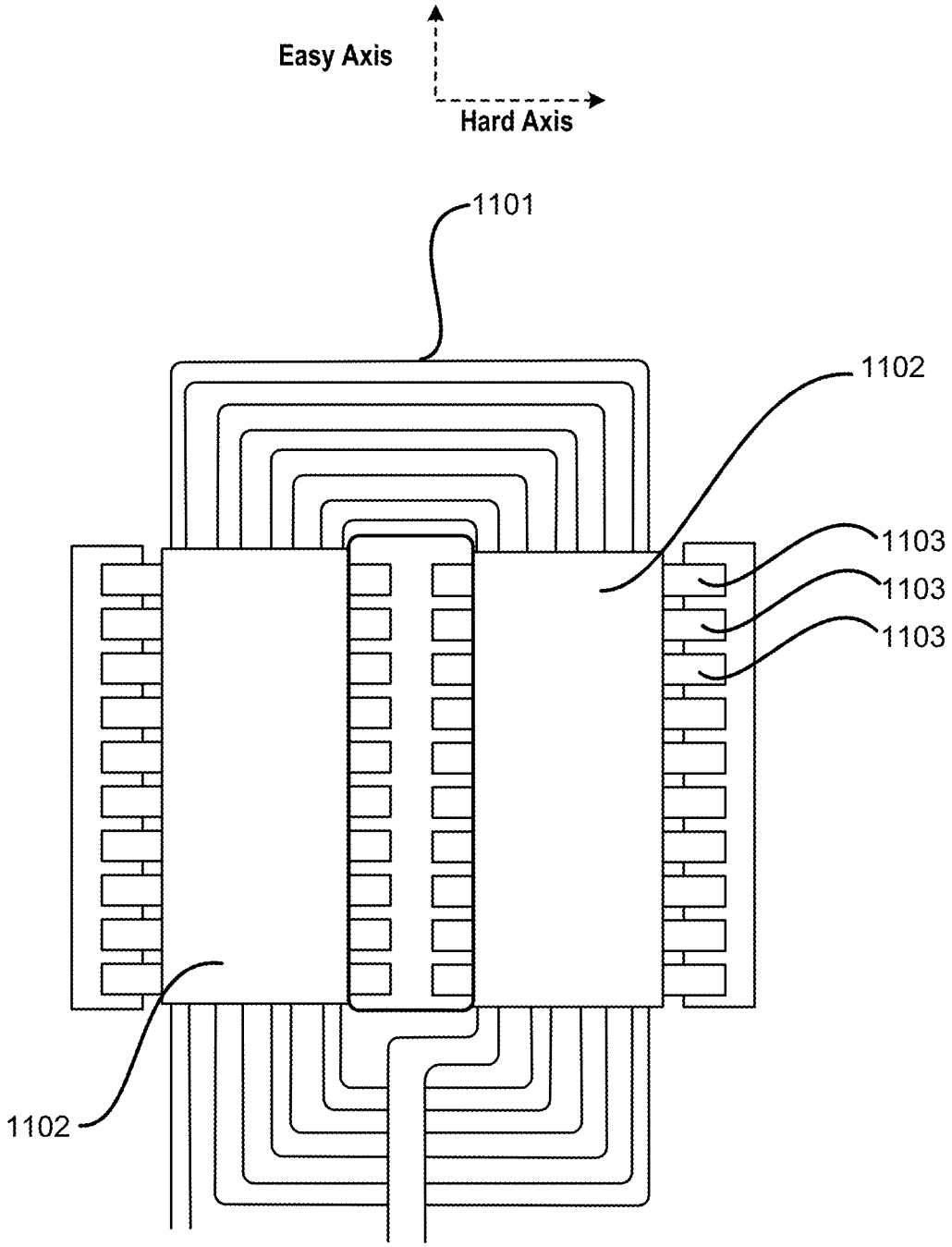
FIG. 11 illustrates various aspects of an integrated tunable inductor according to various example embodiments comprising a magnetic material comprising a combination of structures.

In some embodiments, an integrated tunable inductor comprises a magnetic material 103 made of a combination of structures. For example, with reference to FIG. 11, in various embodiments, an integrated tunable inductor comprises a film 1102 of magnetic material 103. In various embodiments, a planar inductor 1101 may comprise a one to ten turn concentric spiral. In various embodiments, a planar inductor 1101 may comprise a four turn concentric spiral. A film 1102 of magnetic material 103 may comprise a discontinuous ring of magnetic material. For example, rather than being a continuous ring of magnetic material 103, in various embodiments, the ring may further comprise finger-shaped magnetic vias 1103, for example, connecting the portion of the ring above the planar inductor 1101 to the portion of the ring below the planar inductor 1101. In various embodiments, an integrated tunable inductor may comprise two rings of magnetic material 103 further comprising finger-shaped magnetic vias, for example, circling two different portions of planar inductor 1101.

Figure 7:
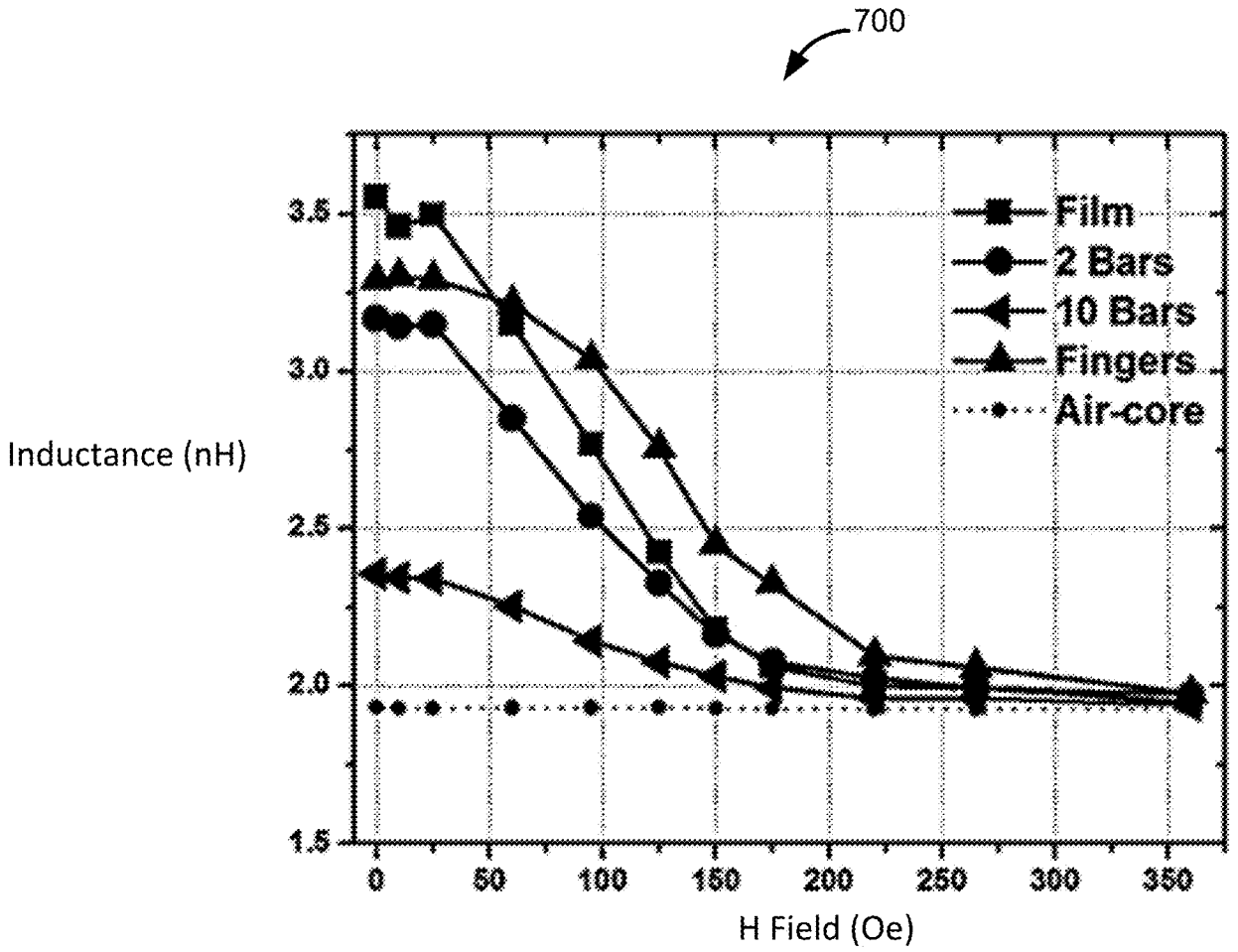
FIG. 7 illustrates a graph of the performance of various example embodiments of an integrated tunable inductor wherein different example embodiments of a planar inductor are implemented.

With reference now to FIG. 7, a graph 700 illustrates the above discussed relative behaviors of some different embodiments of integrated tunable inductors comprised of different magnetic material 103 configurations. In particular, the asymptotic behavior of the inductance curves of graph 700 demonstrates the tendency of the different embodiments to reach a state of full saturation magnetic flux density at different magnetic field strengths.

Figure 8:
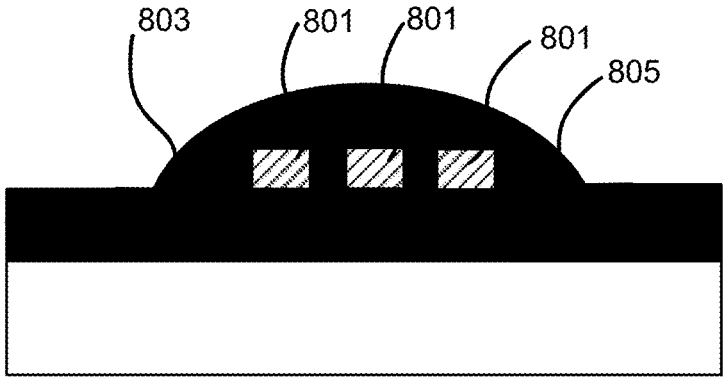
FIG. 8 illustrates an integrated tunable inductor according to various example embodiments.

With reference now to FIG. 8, in some embodiments, magnetic material 803 may be insulated from the planar inductor 801 by a layer of insulating material 805. In various embodiments, insulating material 805 may be polyamide. Furthermore, insulating material 805 may comprise benzocyclobutene, silicon dioxide, and/or any other suitable insulation material.

Returning now to FIG. 1, in some embodiments, a control line 105 is located proximate to magnetic material 103. For example, control line 105 may be positioned at a distance from about 0 μm to about 10 μm from magnetic material 103. However, control line 105 may be positioned at any distance from magnetic material 103 sufficiently proximate that a desired current passing through control line 105 will induce a desired relative magnetic flux density in magnetic material 103. In various example embodiments, control line 105 is positioned about 0.5 μm from magnetic material 103.

In some embodiments, control line 105 is about 5 μm wide and about 5 μm thick. However, control line 105 may have any suitable width and thickness capable of passing a desired magnitude of electrical current at a desired potential. For example, control line 105 may have a width ranging from about 5 μm to about 100 μm, and a thickness ranging from about 0.5 μm to about 20 μm, though any suitable width and thickness capable of passing a desired magnitude of electrical current at a desired potential may be implemented. In some embodiments, the control line may be made of copper, or silver, or gold, or any other conductive material with low resistivity.

Figure 2:
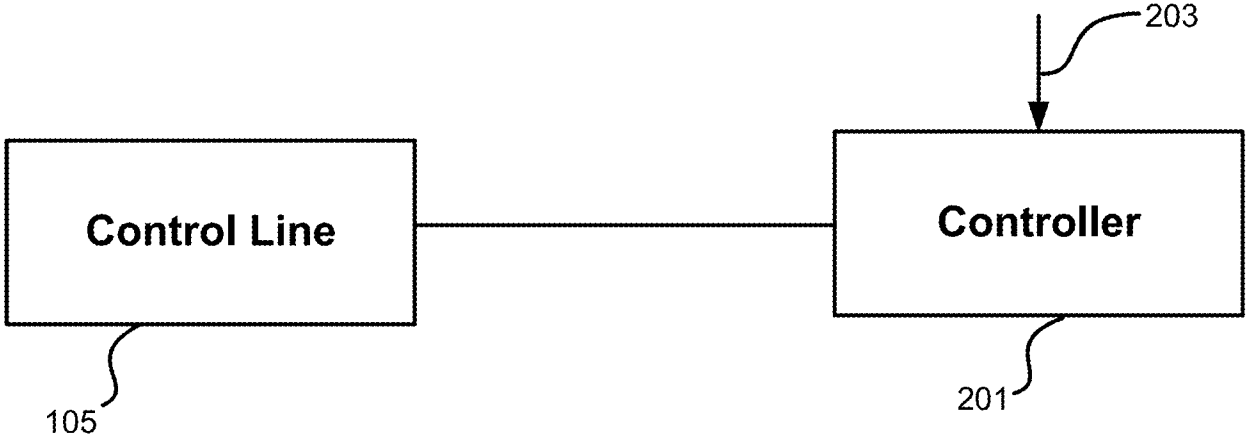
FIG. 2 illustrates a functional diagram of the interconnection of integrated tunable inductor component parts in accordance with various example embodiments.

With reference now to FIG. 2, in some embodiments, control line 105 is in electrical communication with a controller 201. Controller 201 adaptably varies an electrical current passing through control line 105. In some embodiments, this current is variable in response to input signal 203.

Returning to FIG. 1, in some embodiments, control line 105 is oriented to induce an electromagnetic field parallel to an axis of magnetic material 103. In various embodiments, multiple control lines are used in order to adaptably shape the magnetic field induced by the control lines 105 in magnetic material 103. For example, multiple control lines 105 may be used in order to enhance the spatial uniformity of the magnetic field permeating the magnetic material 103.

Figure 3:
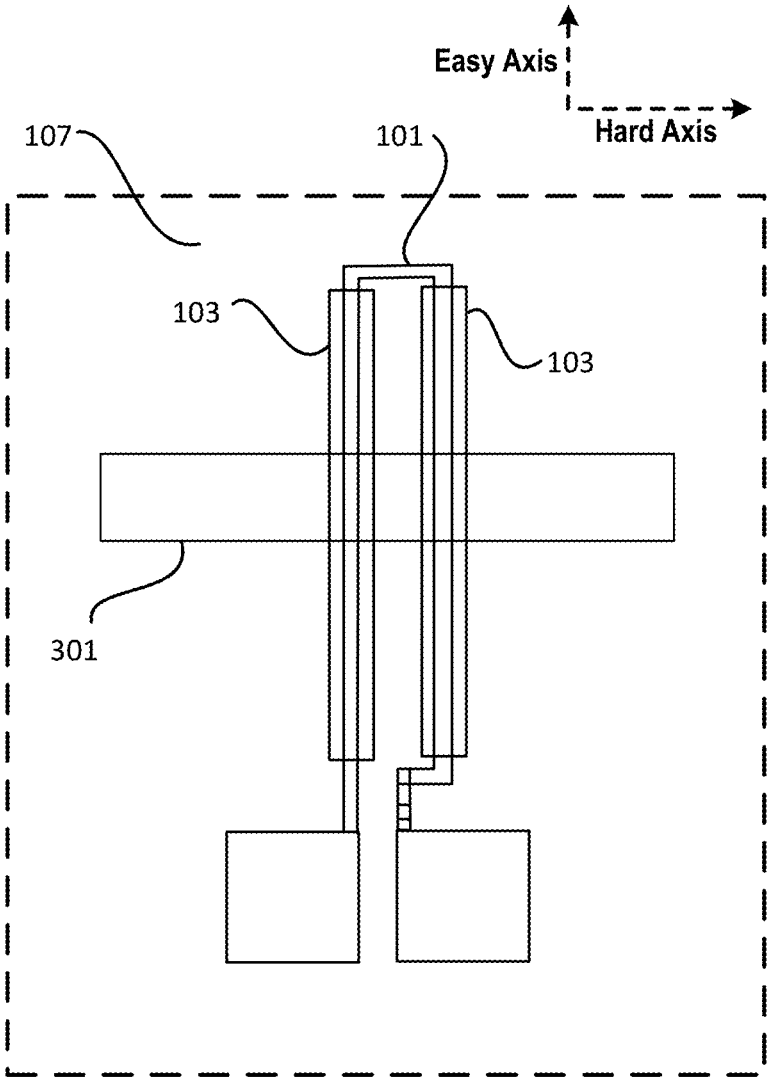
FIG. 3 illustrates an integrated tunable inductor according to various example embodiments wherein the control line passes primarily in the hard axis.
Figure 4:
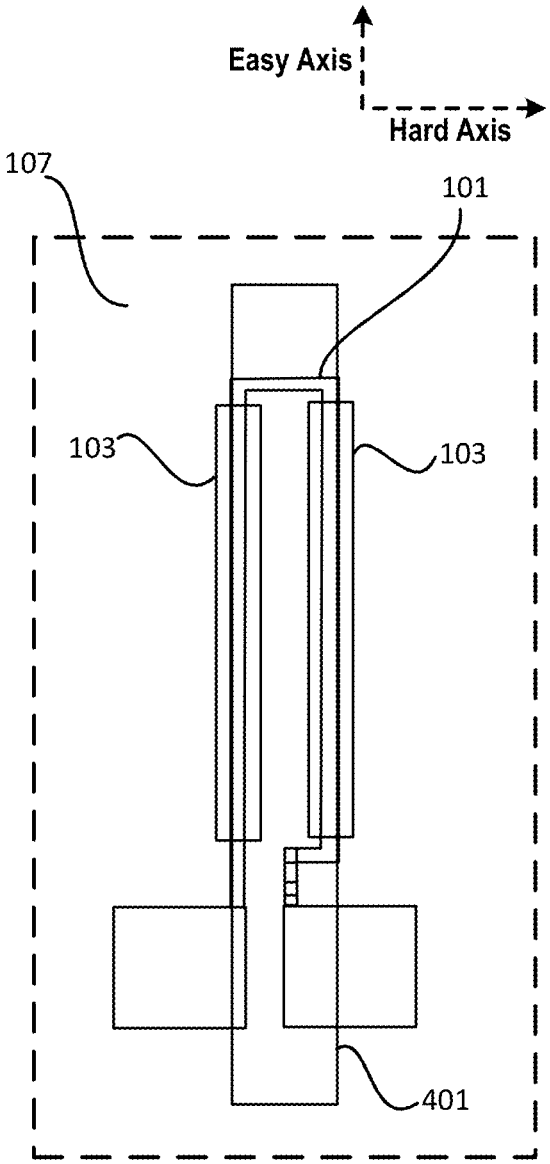
FIG. 4 illustrates an integrated tunable inductor according to various example embodiments wherein the control line passes primarily in the easy axis.
Figure 12:
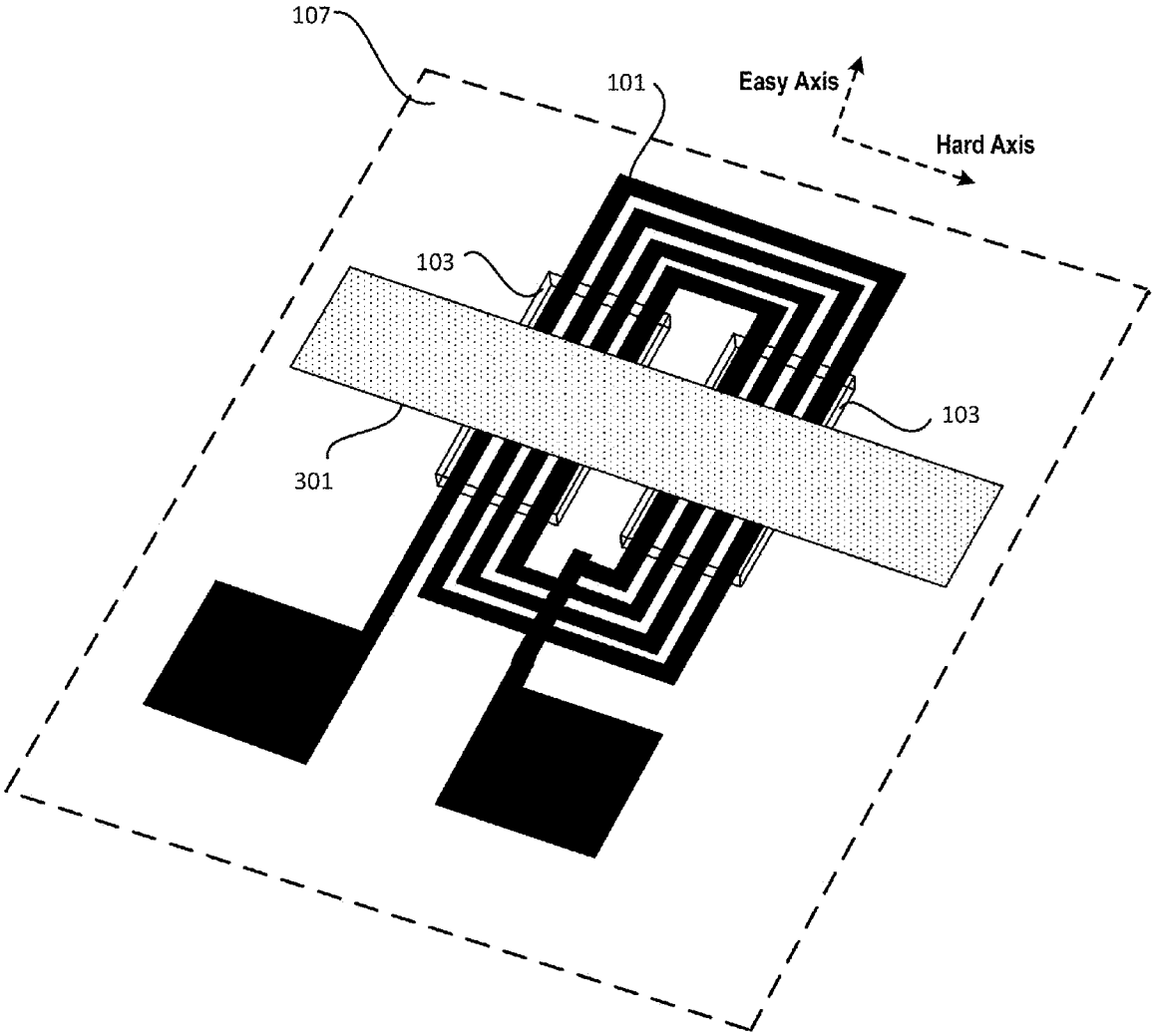
FIG. 12 illustrates an integrated tunable inductor according to various example embodiments wherein the control line passes primarily in the hard axis.

With reference now to FIGS. 3 and 12, in some embodiments, control line 301 is oriented parallel to the hard axis of magnetic material 103. Moreover, with reference to FIG. 4, in some embodiments, control line 401 is oriented parallel to the easy axis of magnetic material 103. By electing among different orientations, the behavior of the device may be changed.

Figure 5:
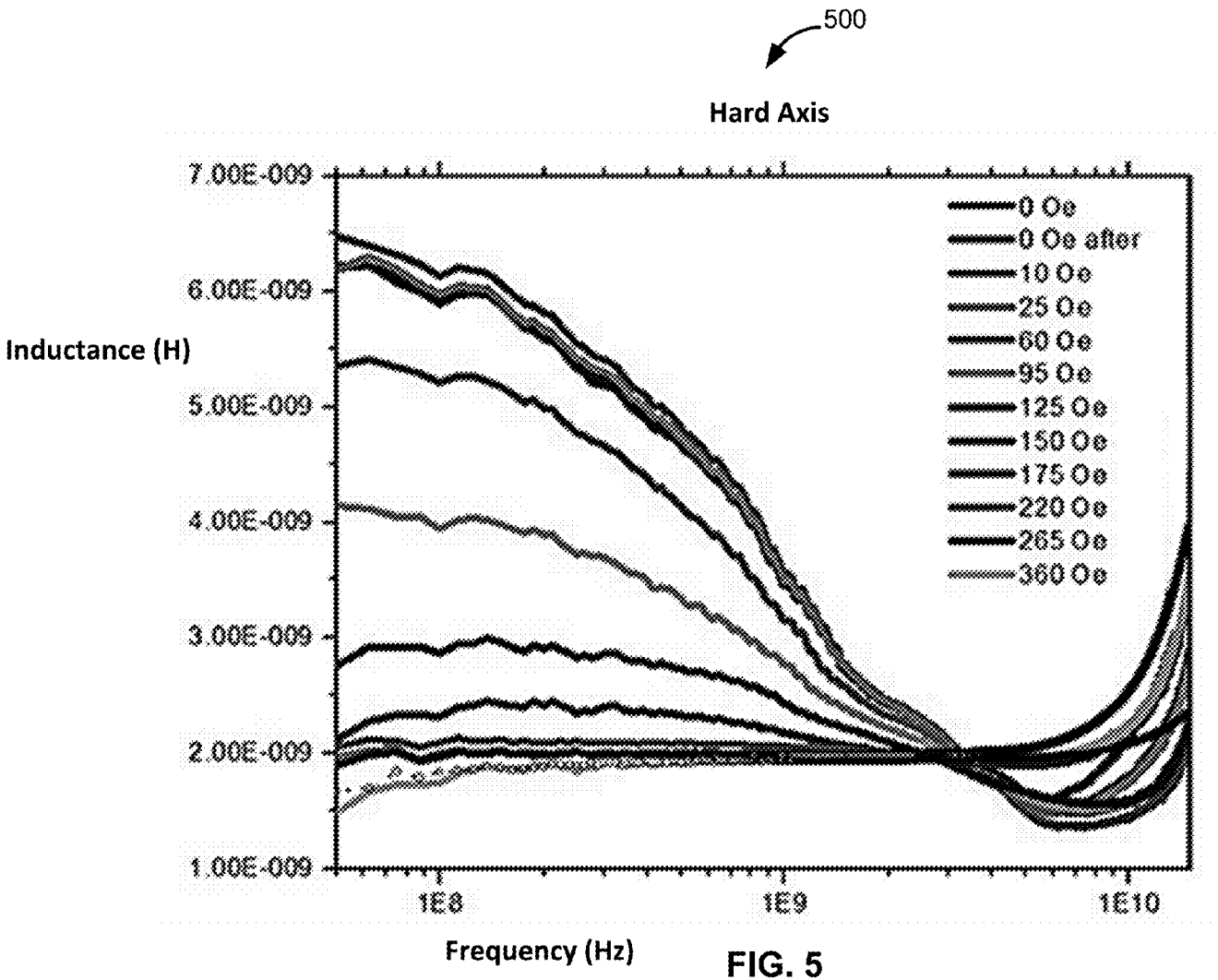
FIG. 5 illustrates a graph of the performance of various example embodiments of an integrated tunable inductor according to FIG. 3.
Figure 6:
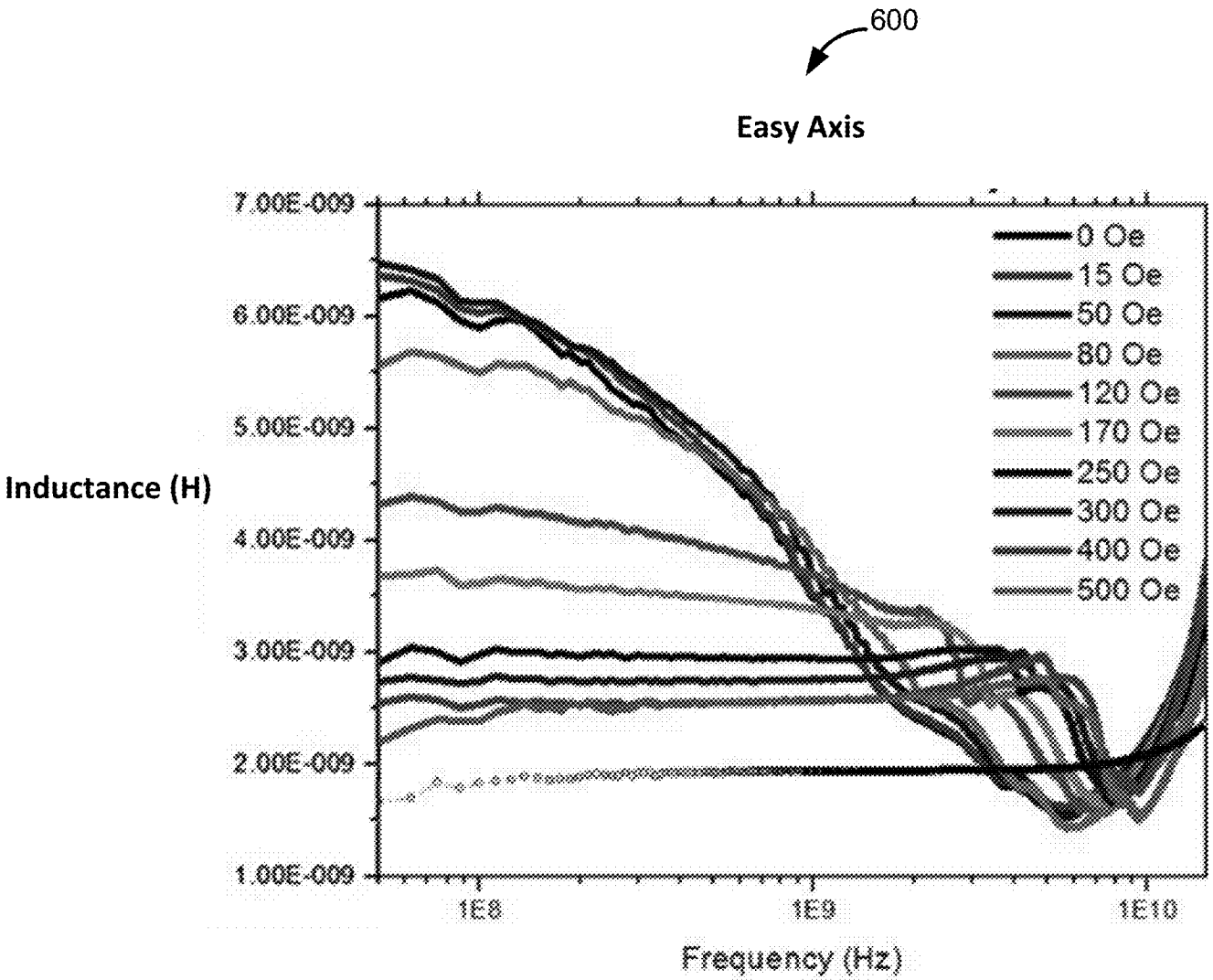
FIG. 6 illustrates a graph of the performance of various example embodiments of an integrated tunable inductor according to FIG. 4.

With reference to FIG. 5, a graph 500 modeling the behavior of various example embodiments wherein the control line (See FIGS. 3 and 12; 301) is oriented parallel to the hard axis of the magnetic material (See FIGS. 3 and 12; 103) can be seen. With reference to FIG. 6, a graph 600 modeling the behavior of various example embodiments wherein the control line (See FIG. 4; 401) is oriented parallel to the easy axis of the magnetic material (See FIG. 4; 103) can be seen. Upon comparison of FIG. 5 and FIG. 6, advantages of each configuration become apparent.

With reference to FIG. 5, a graph 500 illustrating the behavior of various embodiments is illustrated. For example, FIG. 5 illustrates a measured inductance change versus various external magnetic field strengths. In these example embodiments, the control line (Similar to FIGS. 3, 12; 301) is oriented to induce a magnetic field oriented parallel to the hard axis of the magnetic material (See FIGS. 3, 12; 103). As illustrated in graph 500, the exemplary integrated tunable inductor operates with a large inductance tuning range. For example, the exemplary integrated tunable inductor may operate with an inductance tuning range from about 6.5 nH at zero or low magnetic field, to about 2 nH at high field of 265 oersteds (Oe), or 225% tenability. Moreover, the exemplary integrated tunable inductor operates with greater linearity of response to the moderate magnetic field strength between about 25 Oe and about 150 Oe. The greater linearity of response to the magnetic field strength is particularly evident at operating frequencies below about 1 GHz.

With reference to FIG. 6, a graph 600 illustrating the behavior of various embodiments is illustrated. For example, FIG. 6 illustrates a measured inductance change versus various external magnetic field strengths. In these example embodiments, the control line (Similar to FIG. 4; 401) is oriented to induce a magnetic field oriented parallel to the easy axis of the magnetic material (See FIG. 4; 103). In addition to exhibiting a large inductance tuning range similar to FIG. 5, with reference to FIG. 6, as illustrated in graph 600, the exemplary integrated tunable inductor wherein the control line is oriented to induce a magnetic field oriented parallel to the easy axis of the magnetic material operates with greater inductance at much higher frequencies of about 6 GHz at about 500 Oe field versus various exemplary embodiments according to FIG. 5 wherein the control line is oriented to induce a magnetic field oriented parallel to the hard axis of the magnetic material. The greater high frequency inductance is particularly evident at frequencies above about 1 GHz.

Figure 13:
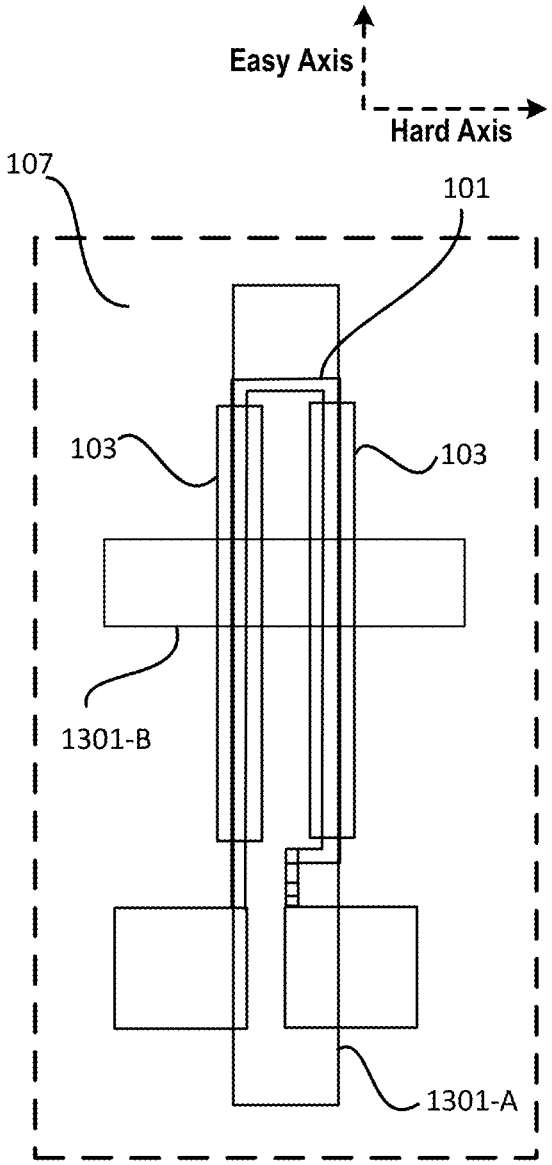
FIG. 13 illustrates an integrated tunable inductor according to various example embodiments having a first control line passing primarily in the hard axis and a second control line passing primarily in the easy axis.

With reference now to FIG. 13, flexibility can be gained by combining, in other exemplary embodiments, control lines both in the hard axis and in the easy axis to further improve the adaptability of an integrated tunable inductor to circuits requiring the advantages of both configurations. In accordance with various embodiments, a control line may be oriented parallel to the hard axis of the magnetic material. In accordance with various embodiments, a control line may be oriented parallel to the easy axis of the magnetic material. In accordance with various embodiments, a first control line or set of control lines 1301-A may be oriented parallel to the easy axis of the magnetic material and a second control line or set of control lines 1301-B may be oriented parallel to the hard axis of the magnetic material.

While the principles of this disclosure have been shown in various embodiments, many modifications of structure, arrangements, proportions, the elements, materials and components, used in practice, which are particularly adapted for a specific environment and operating requirements may be used without departing from the principles and scope of this disclosure. These and other changes or modifications are intended to be included within the scope of the present disclosure and may be expressed in the following claims.

The present disclosure has been described with reference to various embodiments. However, one of ordinary skill in the art appreciates that various modifications and changes can be made without departing from the scope of the present disclosure. Accordingly, the specification is to be regarded in an illustrative rather than a restrictive sense, and all such modifications are intended to be included within the scope of the present disclosure. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element of any or all the claims.

As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Also, as used herein, the terms "proximate," "proximately," or any other variation thereof, are intended to cover a physical connection, an electrical connection, a magnetic connection, an optical connection, a communicative connection, a functional connection, and/or any other connection. When language similar to "at least one of A, B, or C" or "at least one of A, B, and C" is used in the claims, the phrase is intended to mean any of the following: (1) at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C.

What is claimed is:

1. An integrated tunable inductor, comprising:

a substrate configured to receive an inductor;

an inductor located proximate to the substrate;

a magnetic material located proximate to the inductor;

a first control line configured for conduction of electric current and located proximate to the magnetic material, wherein the first control line is configured for the conduction of an electric current material; and a second control line configured for conduction of electric current and located proximate to the magnetic material, wherein the first control line is oriented parallel to a hard axis of the magnetic material, and wherein the second control line is oriented parallel to an easy axis of the magnetic material.

2. The integrated tunable inductor of claim 1, wherein the substrate comprises quartz.

3. The integrated tunable inductor of claim 1, wherein the first control line is oriented to induce an electromagnetic field parallel to an easy axis of the magnetic material.

4. The integrated tunable inductor of claim 1, wherein the first control line is oriented to induce an electromagnetic field parallel to a hard axis of the magnetic material.

5. The integrated tunable inductor of claim 1, wherein the first control line and the second control line are coupled to a controller configured to tune the magnitude of an electric current in the first control line and to tune the magnitude of an electric current in the second control line.

6. The integrated tunable inductor of claim 1, wherein the inductor comprises at least one of: a strip line structure, a solenoidal structure, a toroidal structure, a finger structure, or a bar structure.

7. The integrated tunable inductor of claim 1, wherein the magnetic material comprises CoZrTaB.

8. The integrated tunable inductor of claim 1, wherein the magnetic material comprises a bar structure traversing a portion of the inductor.

9. The integrated tunable inductor of claim 8, wherein the bar structure comprises:

a first series of parallel bars traversing a first portion of the inductor; and a second series of parallel bars traversing a second portion of the inductor, wherein each bar in the first series of parallel bars and the second series of parallel bars does not directly contact any other bar in the first series of parallel bars or the second series of parallel bars.

10. The integrated tunable inductor of claim 9, wherein the first series of parallel bars and the second series of parallel bars create an increased anisotropy magnetic field.

11. The integrated tunable inductor of claim 1, wherein the inductor is a planar inductor.

12. The integrated tunable inductor of claim 11, wherein the planar inductor comprises a concentric planar spiral.

13. The integrated tunable inductor of claim 1, wherein the magnetic material is electrically insulated from the inductor by a layer of insulating material.

14. The integrated tunable inductor of claim 13, wherein the insulating material is polyamide.

* * * * *